US005450154A

United States Patent [19]

Durofil et al.

[11] Patent Number: 5,450,154

[45] Date of Patent: Sep. 12, 1995

[54] STORAGE BUFFER APPARATUS FOR CONTINUOUS-STRIP TYPE PHOTOGRAPHIC MATERIAL

[75] Inventors: Luigi Durofil; Renzo Panontin, both of Pordenone, Italy

[73] Assignee: G.P.E. S.r.l., Pordenone, Italy

[21] Appl. No.: 160,269

[22] Filed: Dec. 2, 1993

[30] Foreign Application Priority Data

Dec. 3, 1992 [IT] Italy ..... PN92A0090

[51] Int. Cl.[6] ..... G03D 3/08; G03D 13/08

[52] U.S. Cl. ..... 354/319; 354/339; 242/417; 242/421.7; 226/118; 226/189

[58] Field of Search ..... 226/118, 119, 189; 242/47.5, 55.1, 55.01; 354/319–323, 339, 342; 118/68

[56] References Cited

U.S. PATENT DOCUMENTS

| | | | |
|---|---|---|---|
| 3,669,375 | 6/1972 | Bruton | 242/417.2 |
| 4,215,827 | 8/1980 | Roberts et al. | 242/364.3 |
| 4,341,453 | 7/1982 | Rubin | 354/319 X |
| 4,436,292 | 3/1984 | Pfannschmidt | 118/68 X |
| 4,769,098 | 9/1988 | Cederholm et al. | 242/553 |
| 4,930,672 | 6/1990 | Renzo | 226/119 |
| 4,967,222 | 10/1990 | Nitsch | 354/321 |

*Primary Examiner*—D. Rutledge

*Attorney, Agent, or Firm*—Wenderoth, Lind & Ponack

[57] ABSTRACT

Transfer storage buffer apparatus for interconnecting processing machines for the development and printing of continuous-strip photographic material includes a plurality of rollers arranged on a fixed upper carriage and a movable lower carriage, respectively, at such positions that the material is alternately conveyed over the upper and lower rollers. The lower carriage is driven in both its upward and downward movement by an actuatable and adjustable elevating mechanism in the form of a pulley arrangement. The pulley arrangement includes a bracket sliding vertically on a fixed vertical support and locked to a flexible continuous-transmission element, and a lower pulley and an upper pulley over which the continuous-transmission element extends. A motor supplies power to the elevating mechanism to control the force under which the lower carriage is moved, to thereby regulate the tension on the photographic material.

7 Claims, 3 Drawing Sheets

STORAGE BUFFER APPARATUS FOR CONTINUOUS-STRIP TYPE PHOTOGRAPHIC MATERIAL

BACKGROUND OF THE INVENTION

1. Field of the Invention

This invention relates to a particular type of storage buffer apparatus capable of being built-in inbetween machines for processing continuous-strip type of photographic material, and particularly, not only solely suitable for the development of both negatives and positives of photographic materials.

2. Description of the Related Art

Storage buffers are known to be widely used in industrial photographic development plants so as to enable the various processing machines making up the plant, and used to process photographic material in the form of a continuous strip, to synchronously change the speed or rate at which they are processing the photographic strip, for instance in correspondence with starting or shutdown phases or during transient phases of speed variations that inevitably happen to occur among the individual machines making up the plant.

Anyone skilled in the art is furthermore well aware of the fact that such storage buffers should be as compact as possible so as to be able to be conveniently installed even in areas with a limited availability of floor space or, anyway, in restricted areas, while being at the same time fully capable of satisfactorily the largest possible amount of photographic material in as small a space as possible, without the photographic material being exposed to any risk of getting damaged by coming into contact either with itself or dangerous parts of the storage buffer.

Various solutions have therefore been aimed at solving the problem of the availability of efficient, convenient and practical storage buffers. One of the most valid among these solutions is the one described in Italian patent application no. 83455/A/87, which discloses a specific type of storage apparatus for material in the form of a continuous strip, in particular photographic material, equipped with rows of rollers having their rotary axes inclined along the horizontal direction, as well as lower carriages that keep the strip material tensioned due to their own weight.

Such a solution, however, while improving the efficacy of previously developed solutions, still has some drawbacks which become increasingly apparent as operational needs become more exacting. These drawbacks can be summarized as follows:

1) Inertia of the continuous strip

In correspondence of sharp or abrupt accelerations or decelerations in the speed at which the continuous strip is progressing, temporary "redundancies" of strip between pairs of rollers arranged in series occur, which cause the strip to bulge correspondingly so that, when said "redundancies" are then recovered, the same strip undergoes severe jerks that can prove harmful for its integrity.

2) Contact of material

Furthermore, the above-described bulging effect can cause a length of moving strip to collide with an adjacent length of strip moving in the opposite direction, and this would inevitably cause the photographic material to become damaged in a more or less serious manner.

3) Compactness

The particular structural arrangement of the storage buffer illustrated in the aforementioned patent specification compels the continuous strip into being bent around itself when it passes on from a roller to the next one. However, such a twist of the strip cannot exceed a determined angle per unit of length, since the resulting excessive torsion would otherwise damage or distort the strip. In order to prevent this from occurring, the need arises to increase the smallest allowable distance between the rollers. While this is fully feasible, it nevertheless means that said smallest allowable distance automatically determines a minimum storage volume which cannot be used as a dynamic storage space, i.e. one that can be varied according to actual needs or requirements, and which does not perform any useful function as far as the primary actual purpose in using a storage buffer is concerned, i.e. the ability of automatically adapting its capacity to the varying requirements.

However, such a "minimum storage volume" although not performing any practical function, certainly takes up a lot of space and this therefore results in a poorer overall utilization of the space taken up by the storage buffer in its entirety.

4) Accessibility

A further drawback that can be found in connection with known state-of-art equipment lies in that, if the need arises to intervene for any reason whatsoever, access to the strip can only be gained from at least two opposite sides. This of course requires that such equipment not be installed against a wall but at a certain distance therefrom. As a consequence, this requirement to be complied with when installing the equipment makes these products de facto still bulkier and more space-demanding than is actually created by their own volume, thereby resulting in a still poorer coefficient of space utilization per unit of strip that can be stored dynamically.

5) Interchangeability of access

Storage buffers are currently configured such that the continuous strip enters and exists from two specific sides of the equipment, which are usually opposite to each other and are not reversible, i.e. interchangeable. This non-interchangeability of the inlet and exit sides of the equipment lowers the operability thereof, since it makes its integration with the other processing machines more rigid from both a logistic and a functional standpoint.

SUMMARY OF THE INVENTION

It therefore would be desirable, and it is actually an object of the present invention, to provide a particular type of storage buffer which is capable of being built-in inbetween processing machines used to handle continuous-strip photographic material, does away with the aforementioned drawbacks of the prior art, can be rapidly installed, and is convenient and simple to install and to use, and is finally very reliable, cost-effective and, furthermore, capable of being made through the use of currently available techniques and materials.

According to the invention, the task of tensioning the continuous strip of photographic material with lower rollers arranged on a lower carriage is not carried out by making use of the weight of the carriage, as is done in the prior art, but on the contrary by forcefully pulling the carriage downwards with a motor-driven device.

BRIEF DESCRIPTION OF THE DRAWINGS

For a clearer understanding, the invention will be further described by way of a non-limiting example with reference to the accompanying drawings, in which.

DETAILED DESCRIPTION OF THE PREFERRED EMBODIMENTS

Figure 1:
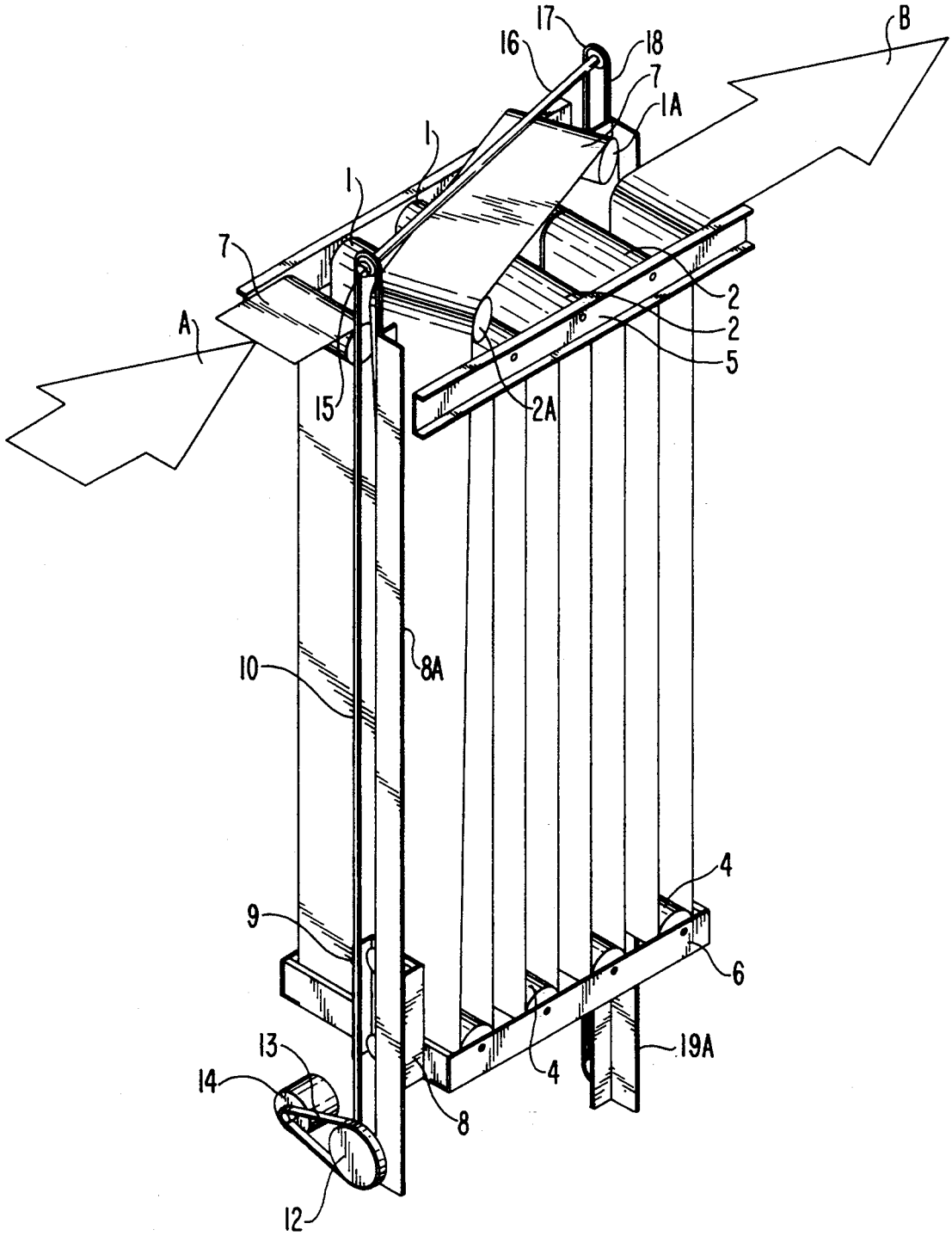
FIG. 1 is a schematical perspective view of a storage buffer apparatus according to the present invention.

Referring now to the Figures, the storage buffer apparatus includes two rows of upper rollers 1 and 2 and two corresponding rows of lower rollers 3 and 4.

The rows of upper rollers are arranged on an upper fixed carriage 5, whereas the rows of lower rollers are arranged on a corresponding lower movable carriage 6.

The continuous strip 7 of photographic material enters the storage buffer apparatus as indicated by the arrow A, becomes engaged by the rows of rollers 1 and 3, is unwound by the last upper roller 1A having its horizontal axis inclined with respect to the orientation of the axes of the rollers in the corresponding rows 1 and 2, reaches the upper roller 2A, which belongs to the upper row 2 and is also inclined so as to prevent the strip from being stretched, becomes alternately engaged by the respective upper and lower rollers in the rows 2 and 4, and finally leaves the storage buffer apparatus in the direction indicated by the arrow B.

The lower movable carriage 6 is fixedly connected with a vertically extending bracket 8, which slides vertically on an appropriate fixed sliding element 8A, for instance a rod. A vertical edge 9 of the bracket 8 is locked to a first vertically extending continuous flexible transmission means 10, typically a closed-loop belt or chain. The means 10 is in turn supported at the bottom thereof by a first lower pulley 11 that is coaxially connected with another pulley 12 which is rotatably driven by a second transmission means 13 that receives in turn its motion from an appropriate motor 14, preferably a brushless-type direct-current motor.

Such a constructional configuration of the apparatus can of course be simplified if the first pulley 11 is directly connected to the drive shaft of the motor 14. However, the feasibility of such a simplification depends on the actually desired gear or speed reduction ratio.

The transmission means 10 is supported at the top by a corresponding first upper pulley 15, which is connected through a transmission shaft 16 with a second pulley 17 being arranged on the opposite side of the storage buffer with respect to said first upper pulley 15.

The second pulley 17 is in turn engaged by a second flexible transmission means 18 having preferably the same characteristics as the transmission means 10. The transmission means 18 is locked to a vertical edge of a second bracket 19, which is fixed to the opposite end of the lower carriage 6, and is further engaged by an idle pulley 20 which is free to rotate, however, in a fixed position.

The second bracket 19 is capable of sliding vertically on a fixed vertical element 19A.

To summarize, a symmetrical constructional configuration is provided in which the lower carriage 6 has, at its opposite sides, two similar brackets 8 and 9 which are locked to respective flexible transmission means 10 and 18 that engage, at the bottom of the apparatus, respective pulleys 11 and 20 and, at the top of the apparatus, two respective pulleys 15 and 17 mutually connected to each other by a transmission shaft 16.

Anyone skilled in the art will at this point be in a position to understand the way in which the present invention actually works, as explained below.

The continuous strip of photographic material is pulled in any per se known manner inside the storage buffer so that it becomes engaged with the rollers. The weight of the lower carriage 6 will forcedly cause the carriage to descend to as low a position as possible, thereby tensioning the continuous strip.

At this point the motor 14 switches on and this motor, appropriately connected to an automatic control and drive system (not shown since it is based on the use of well-known control element that are widely available in the art). the motor 14 is driven to generate a torque that is converted by the two pulleys 11 and 12, the transmission means (belt) 10, the bracket 9 and the upper pulley 15 into an additional force urging the lower carriage downwards.

And it is exactly in this way, i.e. through a torque generated in a regulated manner by the motor 14, that a sufficient pulley action is exerted on the lower carriage as required to achieve the desired tension in the continuous strip.

Furthermore, the provision of elements 16, 17, 18 and 20 to replicate the same downwards pulling force on the other side of the lower carriage eliminates any risk that dissimilar, non-uniform forces will be applied to the carriage. Consequently, two particular types of problems are obviated. The first one of these problems derives from the need of maintaining the movable carriage in a position parallel to the upper fixed carriage under any condition of operation; the second one derives from the need of preventing an unbalanced, uneven tensioning from occurring along the various portions of the continuous strip, since this could cause the paper or photographic material to tear or break.

Various further advantages of the present invention will at this point be apparent. In fact, during speed transients or variations occurring in the processing machines both upstream and downstream of the storage buffer according to the present invention, when such speed variations are out of phase, i.e. have no relationship in time with each other, or when the machines effect different accelerations so as to require a permanent variation in the capacity of the storage buffer and, therefore, a temporary variation in the speed of the photographic material and, ultimately, a rapid acceleration or deceleration of the vertical movement of the movable carriage, the presence of a heavy carriage of a traditional type that is only subject to its own weight actually introduces an element of inertia that limits the magnitude of its acceleration or deceleration to quite a considerable extent.

With the present invention, on the contrary, the movable carriage can be much lighter and this is effective in both reducing its inertia correspondingly and increasing in a considerable manner the rapidity of its vertical movement by the motor-driven positioning device comprising the actuatable and adjustable means for driving the carriage and the motive means for supplying power to the actuatable and adjustable means.

And since the devices can be synchronized with the other processing machines, not only can a greater operational speed be obtained but the occurrence of bulges, slowdowns, jerks and all other drawbacks which the continuous strip is usually exposed to can be prevented.

A further advantage derives from the fact that, even if both faces of the continuous strip alternately come into contact with the surface of the rollers, the possibility of adjusting at will the intensity of the traction exerted on the lower carriage enables the pulling force to be appropriately adjusted so as to avoid or minimize the drawbacks associated with such an occurrence.

It will be further appreciated that, since the rollers are arranged in such a way as to prevent the continuous strip from having to twist upon itself each time that it proceeds from a roller to the next one, it is actually possible to bring the rollers closer to each other, up to the minimum allowable distance required to prevent them from touching each other, which is instrumental in enabling, as is actually a major object of the present invention, the volume physically taken up by the storage to accommodate for the required variations in capacity.

Furthermore, the continuous strip can be introduced from either one of the opposite access sides given the apparent symmetrical configuration of the apparatus, which is not affected by the position of the motor 14 and the devices associated therewith. Therefore, any available space can accommodate the apparatus as long as it enables the rotary motion to be appropriately transmitted from the motor to the pulley 12.

Figure 2:
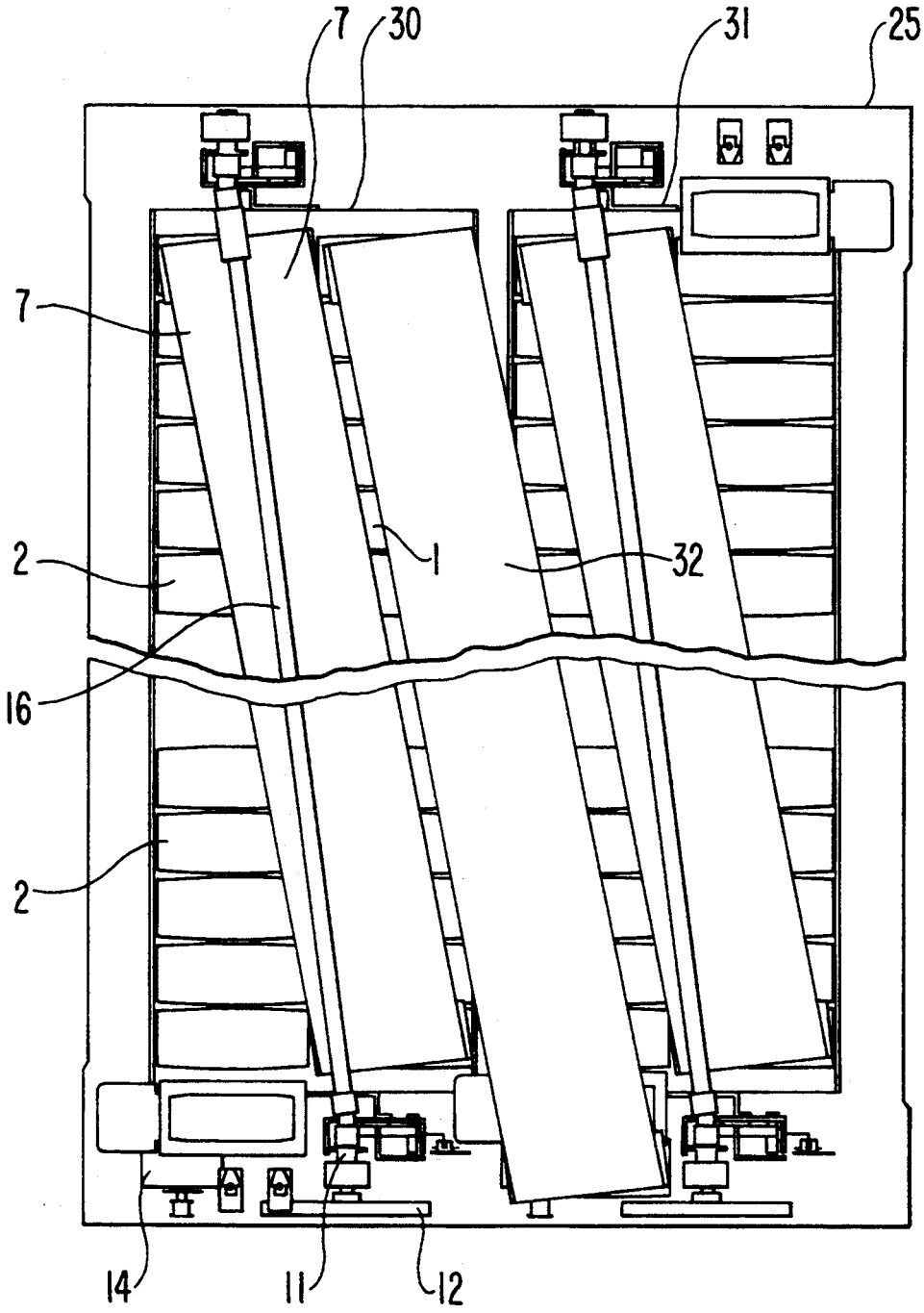
FIG. 2 is a plan view of a double battery arrangement of the storage buffer apparatus shown in FIG. 1.
Figure 5:
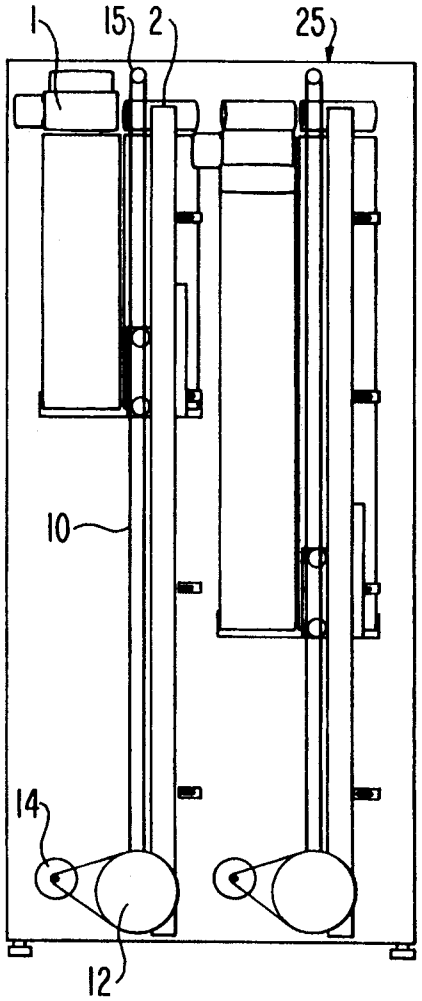
FIGS. 3, 4 and 5 are rear, side and front views, respectively, of a storage buffer apparatus according to the present invention.
Figure 4:
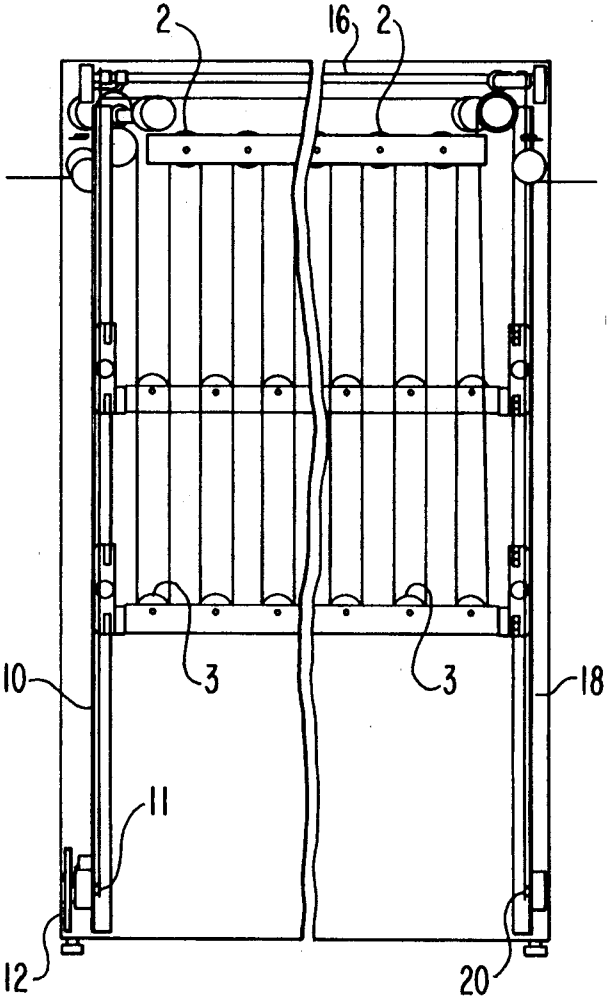
Figure 3:
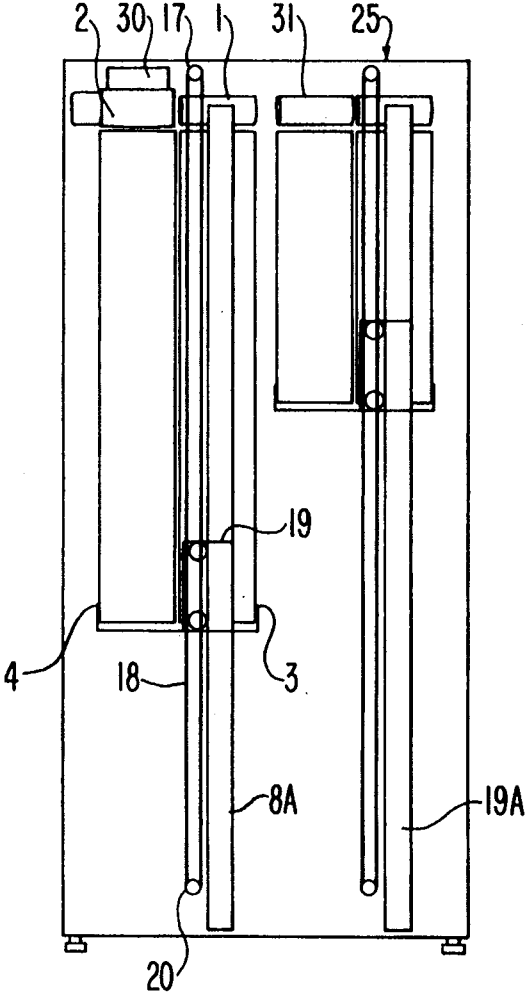

FIGS. 2, 3, 4 and 5 illustrate a particularly advantageous embodiment of the apparatus according to the present invention. As a matter of fact, in a single cabinet 25 two complete transfer storage buffer devices 30 and 31 are housed in a mutually parallel arrangement so as to operate in series with respect to each other. Each one of these devices includes two rows of rollers (wherein each row comprises a set of upper rollers and a corresponding set of lower rollers). Further a length 32 of the continuous strip situated above the devices travels from one of the devices 30 to the other device 31.

The particular advantageous nature of such a configuration will be immediately clear and apparent. In fact, it is possible to access the entire interior from a single side of the cabinet 25, provided that:

A) the levels of the lower carriages are adjusted appropriately according to actual access needs, which can be effected by the present invention, and B) the breadth of the devices is adequately small so that any desired row of rollers can be accessed, which is also facilitated by the particular configuration of the two parallel and contiguous rows of rollers being housed in the same cabinet.

It will be appreciated that the present invention may of course make use of or embody other devices and construction methods that are or may be known in the state of the art. For instance, the first inlet roller and the last outlet roller may be motor-driven rollers and, for the purpose of synchronizing all of the moving elements, a single control and drive system may be provided to automatically govern in a fully synchronized way both the rotary motion of these rollers and the motor 14 transmitting its motion to the movable carriage, based on the signals it received from the sensors that are arranged in various parts of the machine, in particular in correspondence with the photographic material to detect its presence, as well as in correspondence with the motor-driven devices to detect the position of moving elements thereof.

It will of course be further appreciated that what has been described and illustrated above with reference to the accompanying drawings by way of non-limiting example may be the subject of various other modifications without departing from the scope of the present invention as defined by the appended claims.

We claim:

1. Transfer storage buffer apparatus for use in interconnecting processing machines for developing and printing continuous-strip photographic material, said apparatus comprising: a cabinet; two transfer storage buffer devices housed in said cabinet; said devices being disposed in parallel to one another so as to serially convey photographic material; and each of said devices including a fixed upper carriage, a movable lower carriage, two rows of rollers including a plurality of upper rollers mounted to said upper carriage so as to be rotatable and a plurality of lower rollers mounted to said lower carriage so as to be rotatable, each of said rows comprising a respective set of the upper rollers and a respective set of the lower rollers, said rollers being positioned relative to each other such that photographic material can be alternately conveyed over the upper and lower rollers of one of said sets and then alternately conveyed over the upper and lower rollers of the other of said sets, actuatable and adjustable means for driving said lower carriage upwardly and downwardly toward and away from said upper carriage to thereby adjust the distance between said upper rollers and said lower rollers, and motive means for supplying power to said actuatable and adjustable means to force said actuatable and adjustable means to drive said lower carriage selectively toward and away from said upper carriage independently.

2. Transfer storage buffer apparatus as claimed in claim 1, wherein the actuatable and adjustable means of each of said devices comprises a fixed vertical support, a first bracket fixed to said lower carriage and slidably mounted to said fixed vertical support, a flexible continuous-transmission element to which said bracket is locked, and a first lower pulley and a first upper pulley around which said flexible continuous-transmission element extends.

3. Transfer storage buffer as claimed in claim 2, wherein said motive means is a rotary motor having an output shaft connected to a rotary shaft of one of said first pulleys.

4. Transfer storage buffer apparatus according to claim 3, and further comprising another pulley connected to the rotating shaft of said one of said first pulleys, and another flexible continuous-transmission element connected to the output shaft of said motor and extending over said another pulley.

5. Transfer storage buffer apparatus according to claim 4, wherein said actuable and adjustable means includes a second pulley disposed on the opposite side of the storage buffer apparatus with respect to the other of said first pulleys, a second bracket fixed to an end of said lower carriage on the opposite side of the storage buffer apparatus with respect to said first bracket, an idle pulley that is free to rotate about a fixed axis, a second vertical fixed support to which said second bracket is slidably mounted, a second flexible continuous-transmission element extending around said second upper pulley and said idle pulley, and a transmission element connecting said other of said first pulleys and said second pulley.

6. Transfer storage buffer apparatus as claimed in claim 3, wherein said motor is a brushless DC motor.

7. Transfer storage buffer as claimed in claim 3, wherein said one of said pulleys is said first lower pulley.

* * * * *